United States Patent [19]

Zboralski et al.

[11] 4,436,022

[45] Mar. 13, 1984

[54] FUME HOOD INCORPORATING HIGH EFFICIENCY AUXILIARY AIR PLENUM

[75] Inventors: Jon A. Zboralski, Manitowoc; Harry N. Grow, Two Rivers; Stephen E. Holschbach, Manitowoc, all of Wis.

[73] Assignee: Hamilton Industries, Inc., Two Rivers, Wis.

[21] Appl. No.: 297,387

[22] Filed: Aug. 28, 1981

[51] Int. Cl.[3] ..... F23J 11/00

[52] U.S. Cl. ..... 98/115 LH; 55/418; 55/DIG. 29; 98/36

[58] Field of Search ..... 55/418, 419, 501, 502, 55/DIG. 29; 98/36, 40 R, 40 D, 115 LH, 115 R; 126/299 D

[56] References Cited

U.S. PATENT DOCUMENTS

| | | | |
|---|---|---|---|
| 2,108,283 | 2/1938 | Drew et al. | 55/501 X |
| 2,251,663 | 8/1941 | Darbo | 55/418 X |
| 3,111,077 | 11/1963 | Cortright | 98/115 LH |
| 3,752,056 | 8/1973 | Chamberlin et al. | 98/115 LH |
| 4,009,647 | 3/1977 | Howorth | 98/36 |
| 4,100,847 | 7/1978 | Norton | 98/36 X |

FOREIGN PATENT DOCUMENTS

| | | | |
|---|---|---|---|
| 2836820 | 3/1980 | Fed. Rep. of Germany | 98/40 D |
| 2064100 | 6/1981 | United Kingdom | 98/115 LH |

*Primary Examiner*—Albert J. Makay
*Assistant Examiner*—Harold Joyce
*Attorney, Agent, or Firm*—Tilton, Fallon, Lungmus

[57] ABSTRACT

An auxiliary air fume hood provided with an improved airflow system for controlling the passage of air through an auxiliary air housing and orienting the flow of air in front of the face of the hood. The hood is designed to capture the auxiliary air through the face of the hood when the temperature of said air is as much as 20° F. higher than the room air temperature.

3 Claims, 5 Drawing Figures

FUME HOOD INCORPORATING HIGH EFFICIENCY AUXILIARY AIR PLENUM

BACKGROUND OF THE INVENTION

This invention relates to fume hoods and, in particular, to a fume hood which is provided with an improved airflow system. Fume hoods are commonly used in the laboratory for providing a ventilated work area for laboratory activities involving hazardous materials, generated fumes, aerosols, gases and particulate matter. The fume hood protects laboratory personnel and equipment by confining, containing and exhausting these materials.

Conventional laboratory fume hoods include an exhaust blower for removing air from the fume hood, and thus draw their air supply completely from the laboratory room. Since these hoods withdraw conditioned air from the laboratory, a considerable amount of expensively heated conditioned air is lost through this type of hood.

Auxiliary air fume hoods are designed to reduce the amount of conditioned air which is consumed by supplying untempered, non-conditioned auxiliary air to the fume hood. Hoods equipped with auxiliary air fans and related duct work derive approximately 70% of their air supply requirements from outside the laboratory building. The auxiliary air which is introduced into the hood and any conditioned air which is drawn into the fume hood from the laboratory must sweep across the entire work surface to prevent the escape of fumes from the hood. In addition, when the sash is closed, the fume hood must be provided with a means for preventing excessive velocities of air at the face of the hood. High face velocities and excessive turbulence are undesirable because they jeopardize the safety of the operator and interfere with normal operations carried out in the work area.

The flow of auxiliary air supply at the face of the hood is affected by the temperature of auxiliary air in comparison to the temperature of the room air. When auxiliary air is supplied at relatively high temperature with respect to room temperature, a significant amount of the auxiliary air drifts into the laboratory room. It is desirable to draw as much as possible of the auxiliary air to the exhaust system so that untempered air does not mix with or dilute room air and thereby interfere with attempts to provide a comfortable work environment. Heretofore, fume hoods having auxiliary air supply systems have not been able to fulfill the exhaust requirements of fume hoods without undesirably increasing the amount of conditioned air which is drawn into these hoods. In addition, these fume hoods have not had provisions to capture a significant portion of the auxiliary air when the temperature of the auxiliary air is greater than that of the room air.

SUMMARY OF THE INVENTION

The invention provides a fume hood having an auxiliary airflow assembly which provides an improved airflow into the fume hood. The improved auxiliary air supply includes a means for sequentially slowing and dispersing the harsh currents of downwardly moving air introduced from the auxiliary air supply, and orienting the auxiliary air towards the face of the hood wherein the constant, even flow of auxiliary air through the front portion of the hood is unaffected when the auxiliary air temperature is warmer than the temperature of the room air. The fume hood operates effectively at reduced static pressure inside the auxiliary air plenum; therefore, the capacity of the auxiliary air blower can be reduced accordingly, resulting in a saving of energy.

DETAILED DESCRIPTION OF THE PREFERRED EMBODIMENT

Figure 1:
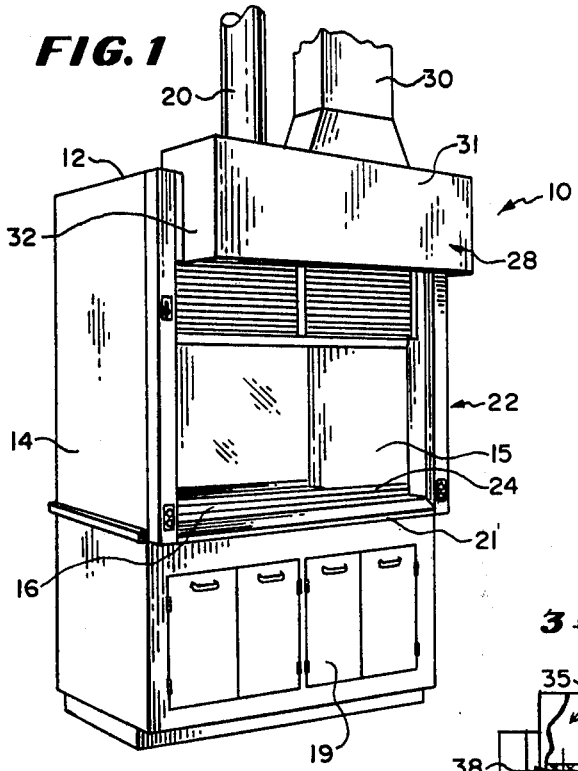
FIG. 1 is a perspective view of a preferred fume hood constructed in accordance with the present invention.
Figure 2:
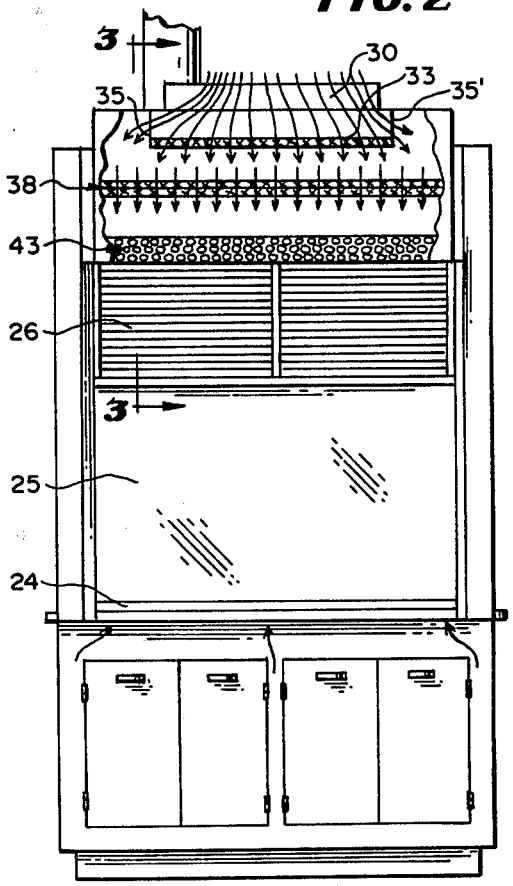
FIG. 2 is a front elevation view, partially broken away, of the fume hood of FIG. 1.
Figure 3:
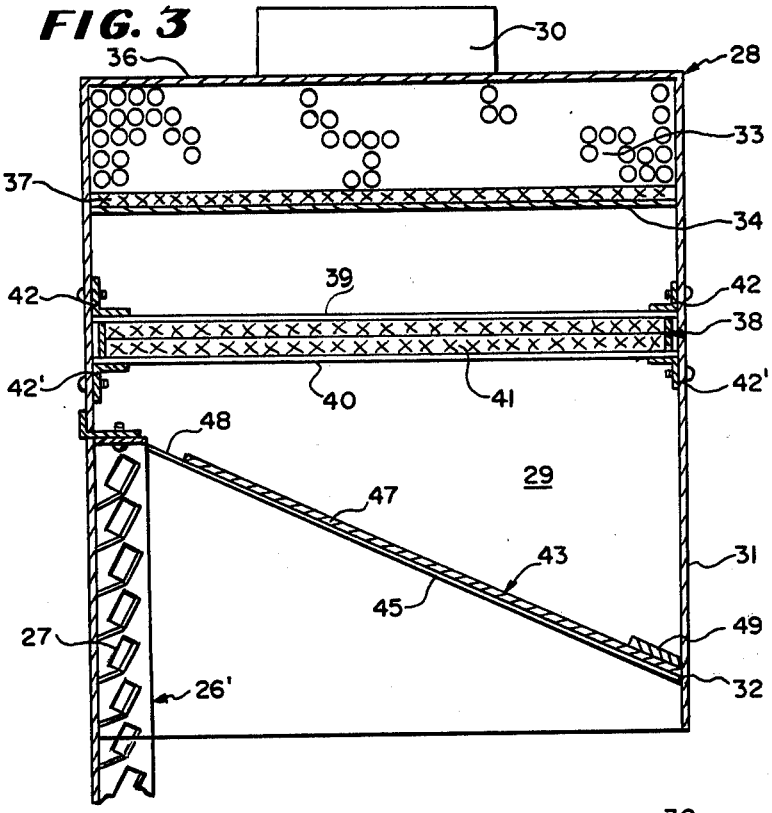
FIG. 3 is an enlarged fragmentary sectional view taken along line 3—3 of FIG. 2.

Referring to FIGS. 1–3, the numeral 10 designates generally a fume hood having a frame which includes a top 12, a rear portion which is not shown, side panels 14 and 15, and a work surface 16, all of which define a work enclosure. An air exhaust system 20 is provided in the fume hood for removing fumes, gases, and hazardous materials. In one embodiment of the present invention, the fume hood contains a cabinet structure 19 for supporting the work enclosure.

The front portion of the fume hood is generally indicated at 22. In order to clearly illustrate how the air flow patterns are achieved in accordance with the present invention, a fume hood having a vertically moving sash is described hereinafter. It is to be understood, however, that the present invention also embodies fume hoods having horizontally moving sashes or fume hoods having no sashes at all. In a preferred embodiment of the present invention, the hood includes a vertically moving sash 24 positioned between the side panels of the frame which is designed to operate as in conventional fume hoods. The sash includes a panel 25 of glass or the like so that the operator of the fume hood can see into the work area. Preferably, a horizontal air foil 21 is located directly above the work surface 16 and provides supplemental airflow through the face of the hood when the sash is closed.

Figure 4:
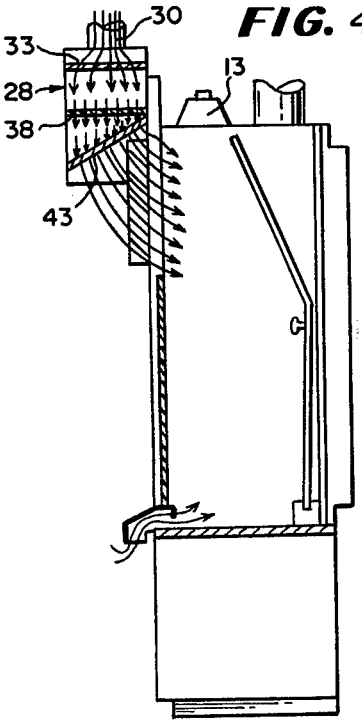
FIG. 4 is a side view of the fume hood in FIG. 2 having the sash lowered.
Figure 5:
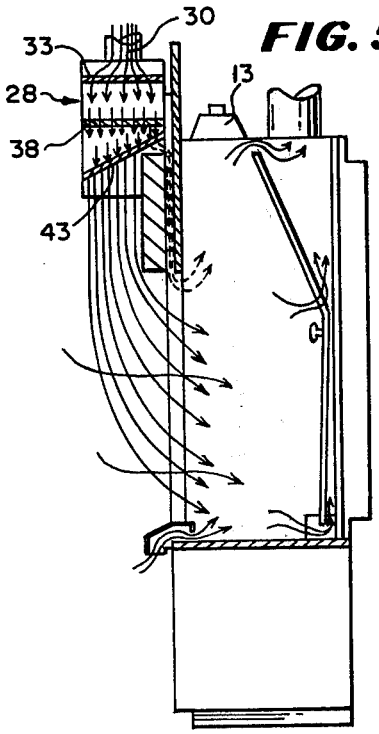
FIG. 5 is a side view of the fume hood of FIG. 2 having the sash raised.

The uppermost portion of the front of the hood contains a bypass opening 26 which provides a means for preventing excessive velocities of airflow into the face of the hood when the sash 24 is lowered. When the sash is lowered, for example, the area behind the bypass opening is open, permitting auxiliary air to enter the hood therethrough. When the sash is raised, blocking airflow through the bypass opening, auxiliary air is directed evenly into the face opening of the hood. The bypass opening 26 on the hood is preferably covered by a louvered grill 27 as shown in FIG. 3. In addition to its contribution to aesthetics by visibly closing the upper portion of auxiliary air, the louvered grill protects the operator from sprays and splashes which occur inside the hood, and shades the operator's eyes from direct view of lights 13 which are conventionally mounted on top 12 of the work chamber of the hood as shown in FIGS. 4 and 5.

In accordance with the present invention, an auxiliary air housing, generally indicated at 28, is mounted on the uppermost portion of the front of the hood 22 and extends outwardly and upwardly therefrom. The auxiliary air housing includes a front wall portion 31, which lies in a plane parallel to that of the front portion of the hood; side portions 32 and 32' (not shown) which extend orthogonally from the front wall 31 and extend into the front portion 22 of the hood; and an access opening 26' on the rear portion of the housing. An auxiliary air supply 30 enters the top portion 36 of the auxiliary air housing.

As shown in FIGS. 2 through 5, the auxiliary air housing provides an air plenum for altering the harsh, turbulent flow of air from the auxiliary air supply 30, and directs the modified airflow down the front portion 22 of the hood.

The overall height of the housing 28 is preferably lower than conventional low-velocity systems, advantageously permitting installations in areas having ceilings as low as eight feet. The housing defines a plenum 29 having a series of air-diffusing stages which provide a means for diffusing the auxiliary air flow, as best shown in FIGS. 2 and 3.

In accordance with the present invention, the primary means for diffusing the auxiliary air may be thought of as a basket 33, whereas the corresponding diffuser stage of conventional hoods consists only of a perforated metal plate which is open at the ends. The basket-shaped support member is constructed of a perforated material and is preferably metal. The longest horizontal component of the basket-shaped structure 33 is preferably a perforated support member 34 and is slightly larger than the corresponding dimension of the duct opening of the auxiliary air supply 30. The basket-shaped structure is completed by upturned end walls 35 and 35' attached to the horizontal member 34 and the top portion 36 of the auxiliary air housing. The sides 35 and 35' are closed by abutment of the basket-like component against the walls of the housing 28. A layer of filter or diffuser material 37 is positioned on the upper surface of the bottom horizontal perforated support member 34. Preferably, there is no filter or diffuser material positioned on the inner surface of the upturned end walls 35 and 35'. The diffuser material 37 preferably consists of a dimensioned filter mat of narrow sheared strips of thin metal, such as aluminum, randomly and rather loosely compressed.

The secondary means for diffusing auxiliary air is designated generally at 38 and is positioned below the primary diffuser stage 33 and includes a first 39, and a second 40, perforated support member, both of which extend the entire length and width of the housing 28 and are secured to the walls thereof. One or more layers of diffuser material 41 are supported between the first and second support members. These perforated support members preferably have 90-degree flanged edges 42 and 42' at each end thereof, which are designed to allow one set of flanges to nest inside the other when assembled in apposed relationship. A long, narrow encapsulement is thereby formed for one or more thicknesses of the diffuser material.

The tertiary means for diffusing the auxiliary air is generally designated at 43. This diffusing stage includes a downwardly depending baffle member 45 which depends down and away from the front portion 22 of the hood and is preferably slanted approximately 30 degrees away from the hood. The baffle member 45 is a perforated support and is preferably secured to the front and rear portions of the auxiliary air housing. In a preferred embodiment of the present invention, the front wall portion 31 of the auxiliary air housing extends lower than the forward termination 32 of the downwardly depending baffle 45. Most preferably, the forward termination 32 of the slanted member 45 is located approximately four inches above the termination of the front wall of the housing. A first layer of diffuser material 47 is positioned on the downwardly-depending baffle 45.

In one embodiment of the present invention as shown in FIG. 3, a portion of the support member 45 located immediately forward of the housing rear wall has an opening 48 that does not have a layer of diffuser material 47 thereon. As shown in FIG. 5 by dotted lines, when the sash 24 is raised, a relatively strong but small amount of downwardly routed auxiliary air flows through this opening 48, which is not covered by diffuser material. Preferably, the length of the opening 48 is about 17% of the total length of the support member 45. In a preferred embodiment of the present invention, this corresponds to approximately two inches. A portion of the support member 45 immediately rearward of the housing front wall 31 has a second layer 49 of diffuser material secured thereon. The second layer of diffuser material 49 preferably extends across the width of the third diffuser stage and extends rearward of the housing front wall approximately 17% of the length of the support member. In a preferred embodiment of the present invention, this corresponds to approximately two inches. Thus, by way of example, in an auxiliary air plenum having a baffle 12 inches long, the area extending approximately ten inches forward of the opening 48 is covered by one thickness of diffuser material and the area extending two inches rearward of the housing front wall 31 is covered by two thicknesses of diffuser material.

PRINCIPLES OF OPERATION

Strong, harsh currents of downwardly moving air are introduced from the auxiliary air duct work 30 as shown in FIGS. 2, 4, and 5. The currents are slowed and dispersed in a multi-directional manner, which is the beginning of the rendering of a gentle quality as the air passes through the first diffuser stage 33. This stage, which is slightly wider than the duct work so that the static pressure of the air is spread over the entire width of the plenum, is somewhat uneven in the chamber formed between the first and second diffuser stages. The air then passes through the members of the second diffuser stage 38, which consists of two perforated metal sheets and preferably two thicknesses of filter material. Further refinement of the gentle flowing is achieved as the air flows through this stage. The distributed air then flows, in an even, downward direction towards the third diffuser stage 43.

When the sash of the hood is lowered, as shown in FIG. 4, auxiliary air enters the hood from the third slanted diffuser stage and passes through the louvered grill. When the sash is raised, as shown in FIG. 5, a relatively strong but small amount of downwardly routed auxiliary air flows through the small opening in the perforated support member which is not covered by filter material. This is shown by the dotted lines. An intermediately strong and greater amount of downwardly routed auxiliary air flows through the large area of the perforated metal, which is covered by one thickness of aluminum filter material. A relatively weak, small amount of downwardly routed auxiliary air flows through the area of the perforated support member which is covered by two thicknesses of aluminum filter material. Thus, three areas of resistance to airflow are achieved at the slanted perforated support member in the preferred embodiment of the present invention, and auxiliary air is evenly diffused across the entire face of the hood. Importantly, all auxiliary air current is oriented towards the face of the hood by the third stage. The downward extension of the front wall of the plenum, approximately four inches in a preferred embodiment of the present invention, also acts to guide auxiliary air currents in front of the face of the hood. In the preferred embodiment of the present invention, at least 95% of the auxiliary air is caused to be captured by the fume hood, and an even flow of auxiliary air is achieved, which is unaffected when auxiliary air temperature is as much as 20° F. higher than the temperature of the air in the laboratory room, at a specified face velocity such as 100 feet per minute.

Having thus described our invention with particular reference to the preferred form thereof, it will be obvious to those skilled in the art to which the invention pertains, to make various changes and other modifications without departing from the spirit and scope of our invention as defined by the claims appended thereto.

We claim:

1. A fume hood comprising a frame including top, rear, and side panels, and an air exhaust opening; a bypass opening on the front portion of the hood; an auxiliary air housing mounted on the uppermost portion of the front of the hood and extending outwardly therefrom; and an access opening on the rear portion of the auxiliary air housing which is disposed at the bypass opening of said hood; wherein said housing further comprises an auxiliary air supply opening; a primary means for diffusing a downward flow of air from the air supply, said primary means disposed adjacent to the auxiliary air supply opening; a secondary means for diffusing the downward flow of air, said secondary means positioned below the primary means; a tertiary means for diffusing the downward flow of air and directing the passage of said air flow in front of the front portion of the hood, wherein said tertiary means includes a downwardly depending baffle which slopes downwardly away from the front of the hood from an area directly above said bypass opening; said baffle comprising a perforated support member having a layer of porous diffuser material thereon; said support member having a perforated rear portion disposed immediately in front of the upper margin of said bypass opening which is free of said diffuser material; said baffle also including a front portion extending along the lower forward margin thereof providing a second layer of diffuser material; said front portion of said baffle and said rear portion of said support member each having a length constituting a minor portion of the length of said baffle measured from front to rear thereof.

2. The fume hood of claim 1 wherein said rear portion of said support member free of said diffuser material has a length of about 17% of the length of said baffle.

3. The fume hood of claims 1 or 2 in which said front portion of said baffle extending along the lower forward margin thereof has a length of about 17% of the length of said baffle.

* * * * *

UNITED STATES PATENT AND TRADEMARK OFFICE

CERTIFICATE OF CORRECTION

PATENT NO. : 4,436,022

DATED : March 13, 1984

INVENTOR(S) :Jon A. Zboralski, Harry N. Grow, Stephen E. Holschbach

It is certified that error appears in the above-identified patent and that said Letters Patent is hereby corrected as shown below:

On the cover page, delete the left-hand figure of drawings.

Signed and Sealed this

*Tenth* Day of *July 1984*

[SEAL]

*Attest:*

GERALD J. MOSSINGHOFF

*Attesting Officer*

*Commissioner of Patents and Trademarks*